US009706887B2

(12) United States Patent
Genn et al.

(10) Patent No.: US 9,706,887 B2
(45) Date of Patent: Jul. 18, 2017

(54) CLEANER-HEAD FOR A VACUUM CLEANER

(71) Applicant: Dyson Technology Limited, Wiltshire (GB)

(72) Inventors: Stuart Lloyd Genn, Swindon (GB); Matthew John Dobson, Gloucester (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 92 days.

(21) Appl. No.: 14/347,993

(22) PCT Filed: Sep. 29, 2013

(86) PCT No.: PCT/IL2013/050803
§ 371 (c)(1),
(2) Date: Mar. 27, 2014

(87) PCT Pub. No.: WO2014/045290
PCT Pub. Date: Mar. 27, 2014

(65) Prior Publication Data

US 2015/0216381 A1 Aug. 6, 2015

(30) Foreign Application Priority Data

Sep. 19, 2012 (GB) ..... 1216738.3

(51) Int. Cl.
*A47L 9/02* (2006.01)
*A47L 9/04* (2006.01)
*A47L 9/06* (2006.01)

(52) U.S. Cl.
CPC . *A47L 9/02* (2013.01); *A47L 9/04* (2013.01); *A47L 9/0673* (2013.01)

(58) Field of Classification Search
CPC ..... A47L 9/02; A47L 9/04; A47L 9/0673
USPC ..... 15/415.1
See application file for complete search history.

(56) References Cited

U.S. PATENT DOCUMENTS 8,418,313 B1 * 4/2013 Miner ..... A47L 9/02 15/325
2010/0257695 A1 10/2010 Maguire et al.

FOREIGN PATENT DOCUMENTS

| | | |
|---|---|---|
| EP | 0 650 689 | 5/1995 |
| WO | WO-2005/111084 | 11/2005 |
| WO | WO-2010/119279 | 10/2010 |

OTHER PUBLICATIONS

Search Report dated Jan. 11, 2013, directed to GB Application No. 1216738.3; 1 page.
International Search Report and Written Opinion mailed Dec. 10, 2013, directed to International Application No. PCT/IL2013/050803; 8 pages.

* cited by examiner

*Primary Examiner* — David Redding
(74) *Attorney, Agent, or Firm* — Morrison & Foerster LLP

(57) ABSTRACT

The invention relates to a cleaner-head for a vacuum cleaner. The cleaner-head has a housing, this housing being connected to a hinged soleplate assembly which can be opened and closed to provide access to the inside of the housing. In accordance with the invention, the soleplate assembly is a clip-on assembly which a user can manually un-clip from the housing, as required, to detach the soleplate assembly for separate cleaning or replacement.

8 Claims, 7 Drawing Sheets

CLEANER-HEAD FOR A VACUUM CLEANER

REFERENCE TO RELATED APPLICATIONS

This application is a national stage application under 35 USC 371 of International Application No. PCT/IL2013/050803, filed Sep. 29, 2013, which claims the priority of United Kingdom Application No. 1216738.3, filed Sep. 19, 2012, the entire contents of which are incorporated herein by reference.

FIELD OF THE INVENTION

The present invention relates to the field of vacuum cleaners, and in particular to a cleaner-head for a vacuum cleaner.

The vacuum cleaner itself may be of any type. For example, the cleaner-head may be a cleaner-head for an upright vacuum cleaner, or alternatively it may be a cleaner head for a floor tool intended to be used with a cylinder vacuum cleaner or stick-vac cleaner. The invention is not limited to cyclonic vacuum cleaners.

BACKGROUND OF THE INVENTION

The underside of a cleaner head typically comprises a soleplate. This is the part which engages with the floor in use. The soleplate is normally a flattish plate—formed from metal or plastic—provided with a relatively large opening which acts as the suction inlet for the cleaner head.

The soleplate may be detachable, either individually or as part of a larger, detachable soleplate assembly. This allows a user to access the inside of the cleaner head for cleaning, removing blockages etc. Alternatively, the soleplate—or soleplate assembly—may be hinged to allow access inside the cleaner head.

SUMMARY OF THE INVENTION

The present invention concerns a cleaner head having a hinged soleplate assembly.

According to the present invention, there is provided a cleaner-head for a vacuum cleaner, the cleaner-head comprising a housing, the housing connected to a hinged soleplate assembly which can be opened and closed to provide access to the inside of the housing, the soleplate assembly being a clip-on assembly which a user can manually un-clip from the housing, as required, to detach the soleplate assembly for separate cleaning or replacement.

Hinged soleplates are convenient: they allow simple access to the inside of the cleaner head without having to disassemble the cleaner head. The problem with conventional, hinged soleplates, however, is that they are not generally removable at all by the user. This makes it difficult for a user to clean or repair the soleplate assembly itself, and impossible to replace the soleplate assembly individually: instead a replacement cleaner head needs to be purchased or else obtained under warranty, even if the remaining parts of the cleaner head do not actually require replacement The present invention addresses this problem by providing a soleplate assembly which is both hinged and removable.

The soleplate assembly is arranged to clip onto the housing. Detaching the soleplate assembly is thus straightforward and can be carried out by the user without any special tools being required.

The soleplate assembly may comprise a first hinge part and the housing may comprise a second hinge part, the two hinge parts being arranged so that a user can clip them together to hinge the soleplate on the housing and then subsequently un-clip them as required to detach the soleplate from the housing. Thus, the hinged connection is formed by clipping together the soleplate assembly and the housing. This is a particularly simple arrangement which can be implemented at low cost using resilient tabs as the first and second hinge parts.

The hinge parts may be provided towards the front of the housing and the soleplate assembly.

In a particular arrangement according to the invention, the soleplate assembly comprises a soleplate and a bumper running along the front of the soleplate, the first hinge part being provided on the bumper.

The hinged soleplate assembly may be held closed on the housing by a catch located towards the rear of the housing.

BRIEF DESCRIPTION OF THE DRAWINGS

Embodiments of the invention will now be described, with reference to the accompanying drawings, in which.

DETAILED DESCRIPTION OF THE INVENTION

Figure 1:
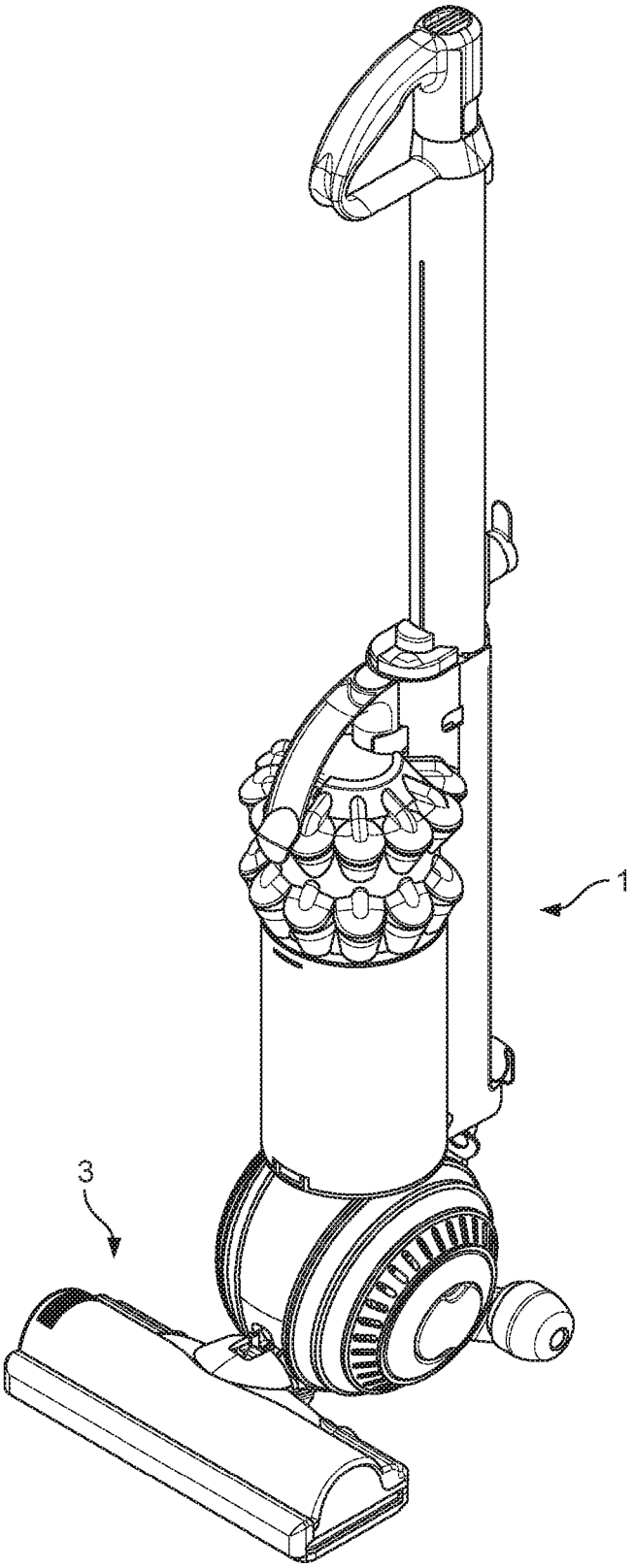
FIG. 1 is a perspective view of an upright vacuum cleaner having a cleaner head.

FIG. 1 shows an upright vacuum cleaner 1 having a cleaner head 3.

Figure 2A:
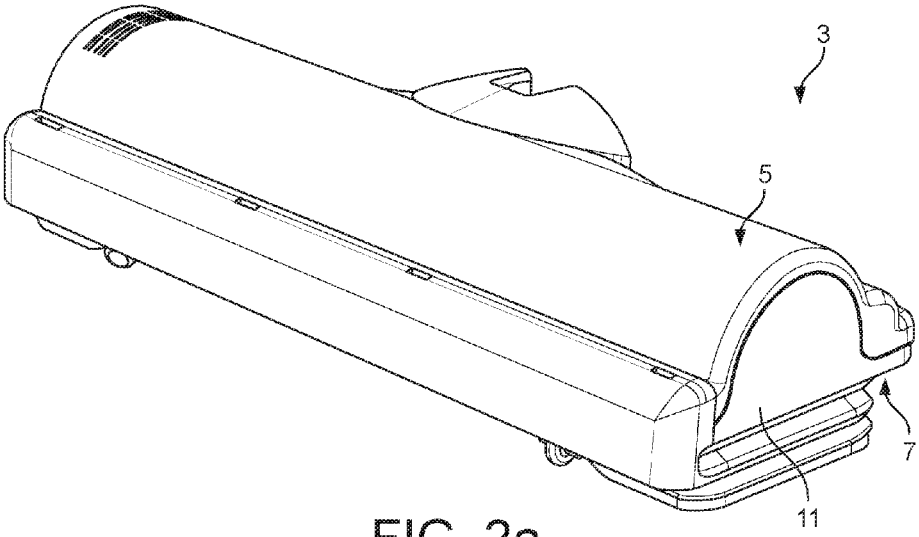
FIG. 2*a* is a perspective view of the above-mentioned cleaner head, but in isolation from the upright vacuum cleaner.
Figure 2B:
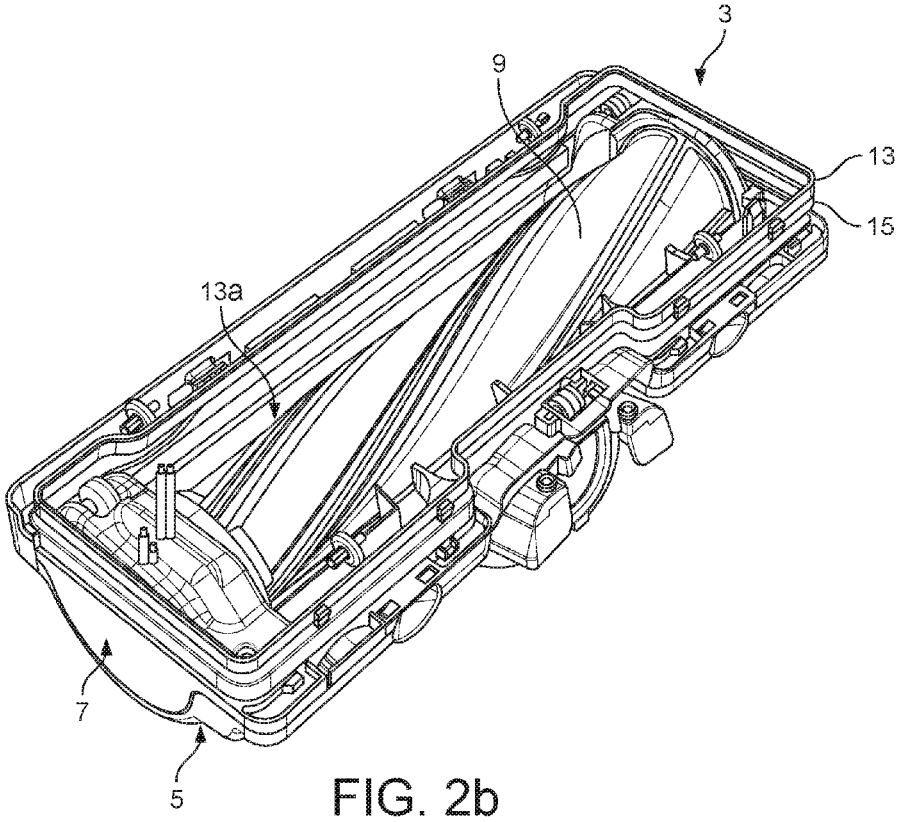
FIG. 2*b* is a perspective view of the cleaner head from underneath, showing the suction opening and brushbar.

The cleaner head 3 is shown in isolation in FIGS. 2*a* and 2*b*. It comprises two parts: a brush bar housing 5 and a soleplate assembly 7.

Figure 3:
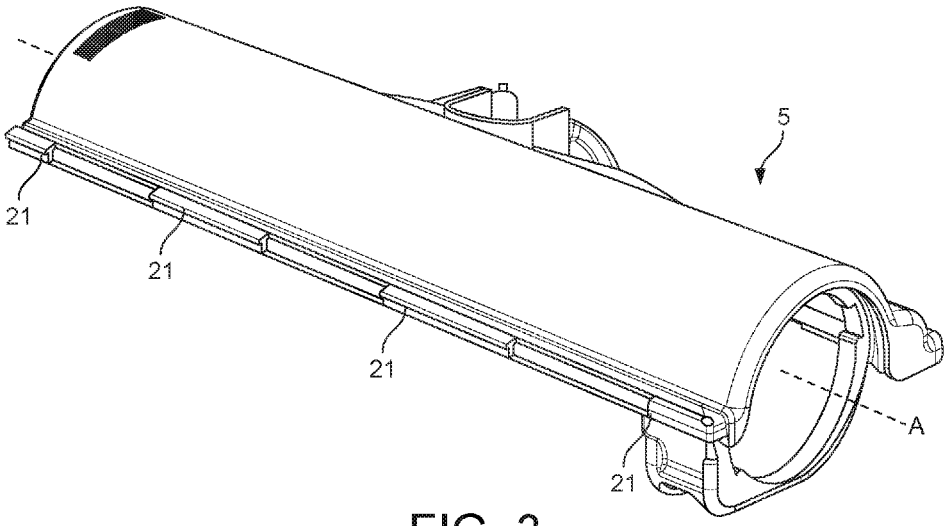
FIG. 3 is a front perspective view of a brush housing forming part of the cleaner head.
Figure 5:
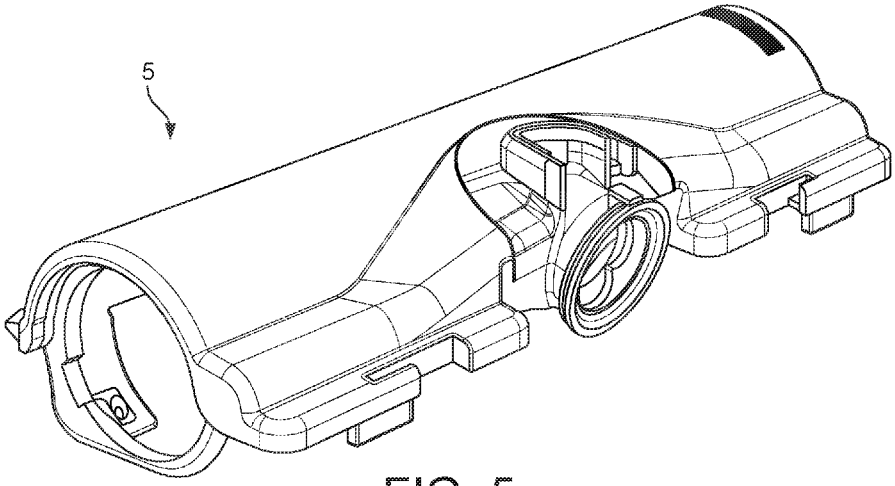
FIG. 5 is a rear perspective view of the brush housing.

The brush bar housing 5 is shown in isolation in FIGS. 3 and 5. It houses a motor-driven brush bar 9 (FIG. 2*b*) which, in use, rotates about the axis A (the drive motor is itself housed inside the brush bar 9).

Figure 4:
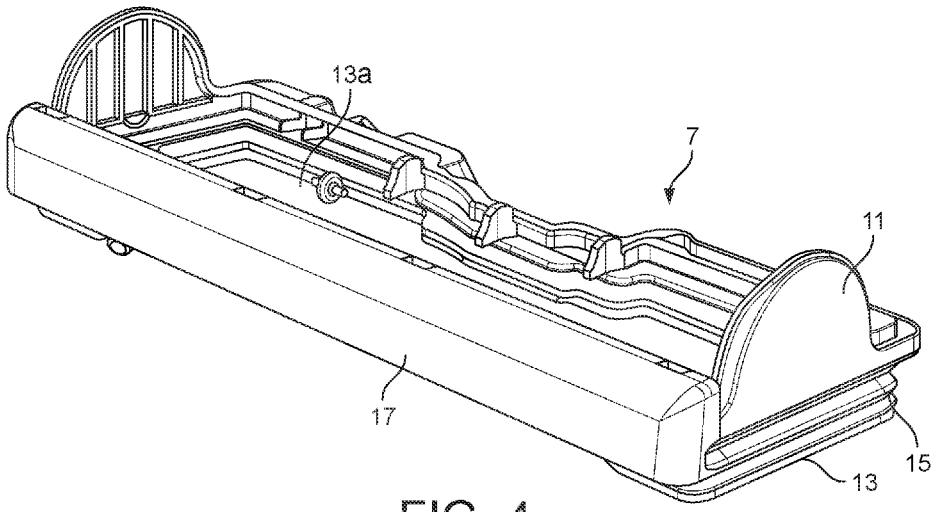
FIG. 4 is a front perspective view of a soleplate assembly forming part of the cleaner head.
Figure 6:
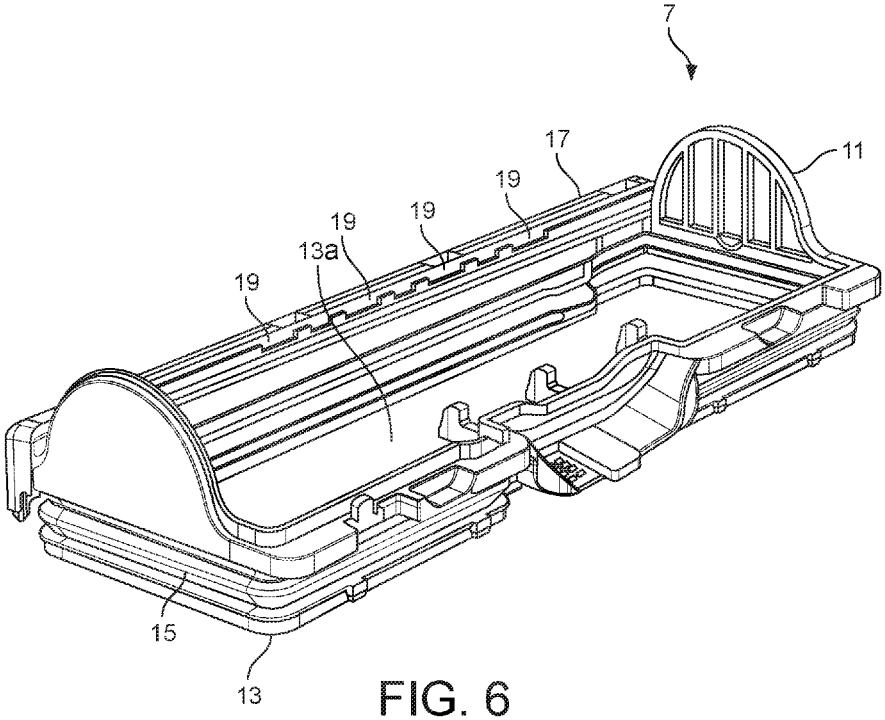
FIG. 6 is a rear perspective view of the soleplate assembly.

The soleplate assembly 7 is shown in isolation in FIGS. 4 and 6. It comprises a chassis 11 and a soleplate 13 which is connected to the chassis 11 via a flexible skirt 15 to give the soleplate 13 a degree of "float" see e.g. PCT Publication No. WO2010/119279.

The soleplate 13 is generally rectangular, and incorporates a relatively large, rectangular suction opening 13*a*, which forms the suction inlet for the cleaner head 3. The suction opening 13*a* is oriented so that it aligns with the brush bar 9.

The soleplate assembly 7 is hinged so that the entire soleplate assembly 7 can be opened and closed, as required, conveniently to access the inside of the brush bar housing 5, for example to access the brush bar 9. The hinge connection between the soleplate assembly 7 and the brush housing 5 is formed by a first hinge part on the soleplate assembly 7, which clips on to a second hinge part on the brush housing 5.

The first hinge part comprises a series of resilient tabs 19 running along the inside of a bumper 17 provided along the front edge of the chassis 11. You can see these resilient tabs 19 in FIG. 6.

The second hinge part comprises a corresponding series of resilient tabs 21 running along the front edge of the brush housing 5. You can see these resilient tabs 21 in FIG. 3.

Figure 7:
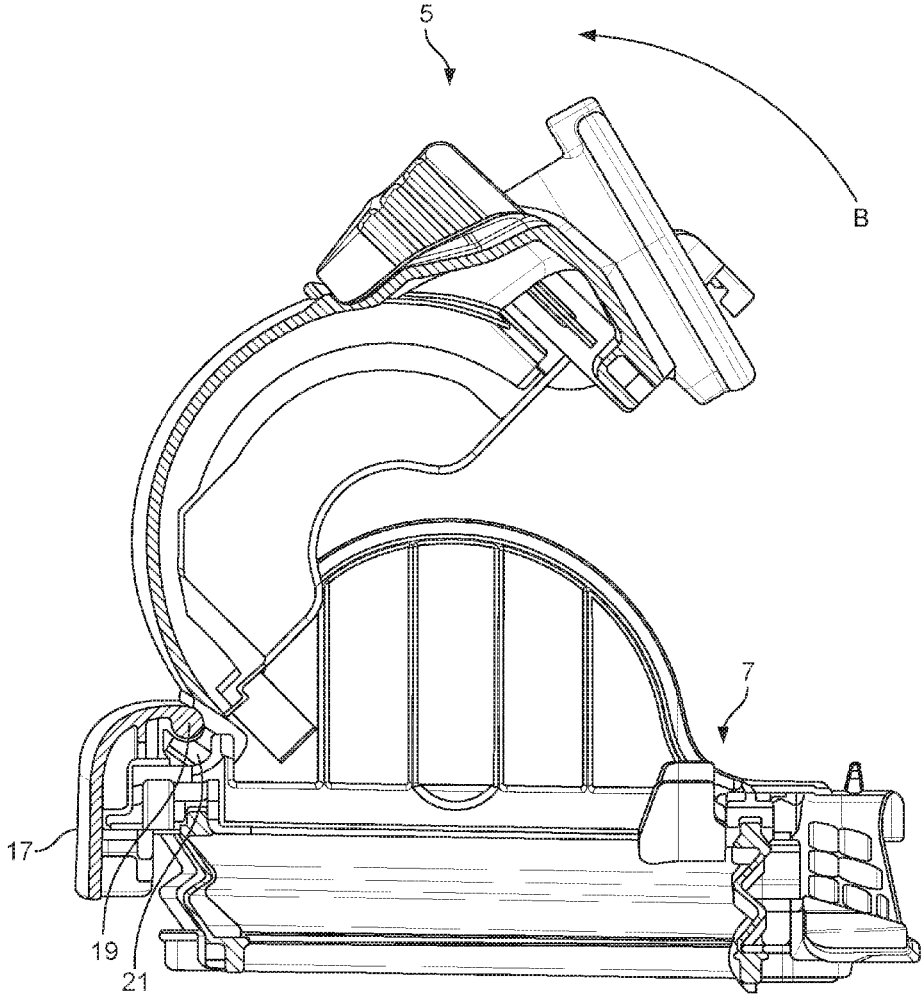
FIG. 7 is a sectional view along A-A, illustrating the hinged connection between the soleplate assembly and the brush housing.

The two sets of resilient tabs 19, 21 manually clip together—as illustrated in FIG. 7—and co-operate to provide the required hinge action B between the soleplate assembly 7 and the brush housing 5.

The two hinge parts are arranged so that, if it is required to detach the soleplate assembly 7 from the housing 5—for example to replace or clean the soleplate assembly 7 individually—the soleplate assembly 7 can simply be un-clipped from the brush housing 5. This is achieved by over-rotating the soleplate assembly 7 and brush housing 5, effectively levering the bumper 17 against the brush housing to force the resilient tabs 19, 21 out of clipping engagement with one another. In effect, the over-rotation of the soleplate assembly is used to prise apart the resilient tabs 21, so that the soleplate assembly 7 can be detached.

As required, the resilient hinge parts 19, 21 can conveniently be clipped back together to reconnect the soleplate assembly 7 and the brush housing 5. The arrangement thus combines the advantages of a hinged connection and the ability to be able to separate the soleplate assembly 7 and brush housing 5 completely as and when required, simply by manually clipping and un-clipping the hinge parts. No separate tools are required to connect and detach the soleplate assembly 7 and brush housing 5.

Figure 8:
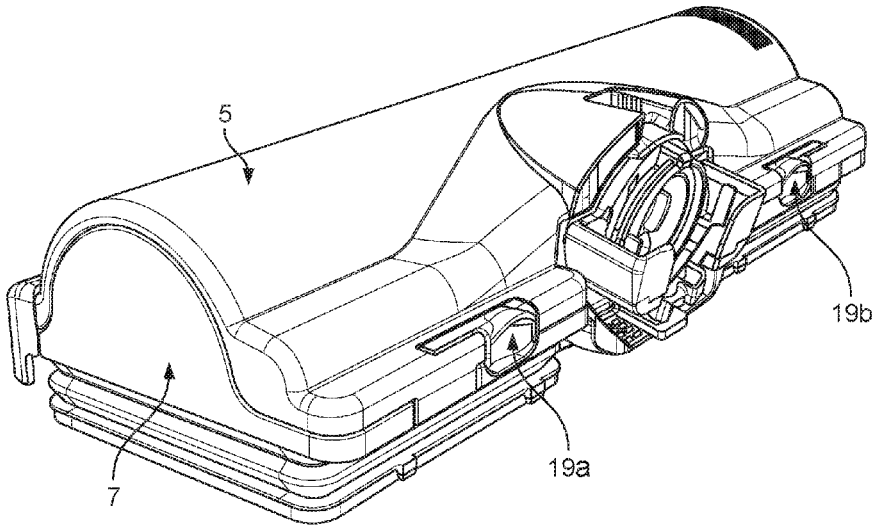
FIG. 8 is a rear perspective view of the assembled cleaner head.

The soleplate assembly 7 is held closed by two pivotable catches 19*a*, 19*b* mounted on a rear part of the brush housing 5. You can see these catches in FIG. 8. The two catches 19*a*, 19*b* are spaced apart so that the catch 19*a* is positioned towards the left-hand side of the brush housing 5 (looking from the rear of the brush housing 5, as in FIG. 8) and the other catch 19*b* is positioned towards the right-hand side of the brush housing 5 (again, looking from the rear of the brush housing 5).

Figure 9A:
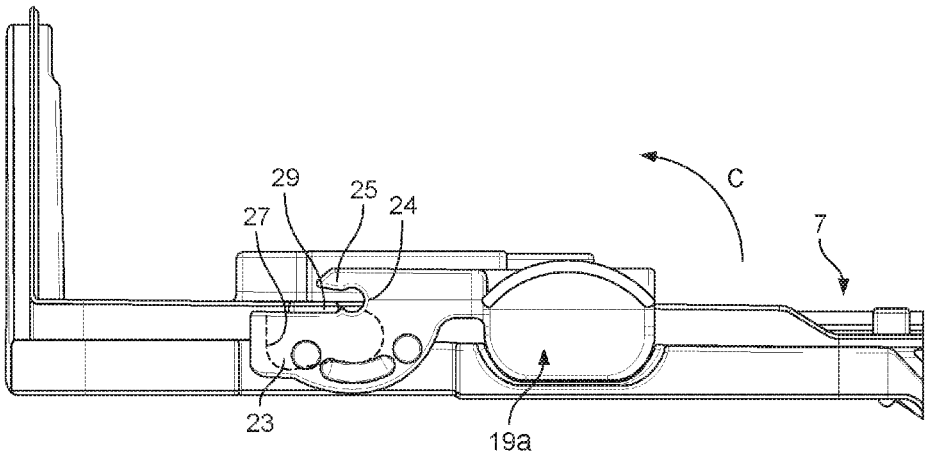
FIGS. 9*a*-9*c* show a rear part of the cleaner head comprising a catch in a locking position, an intermediate position and a release position, respectively.
Figure 9B:
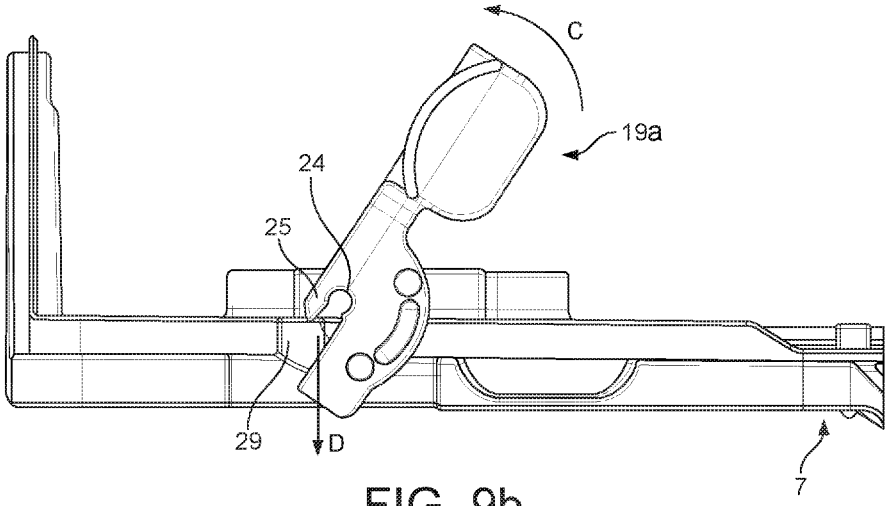
Figure 9C:
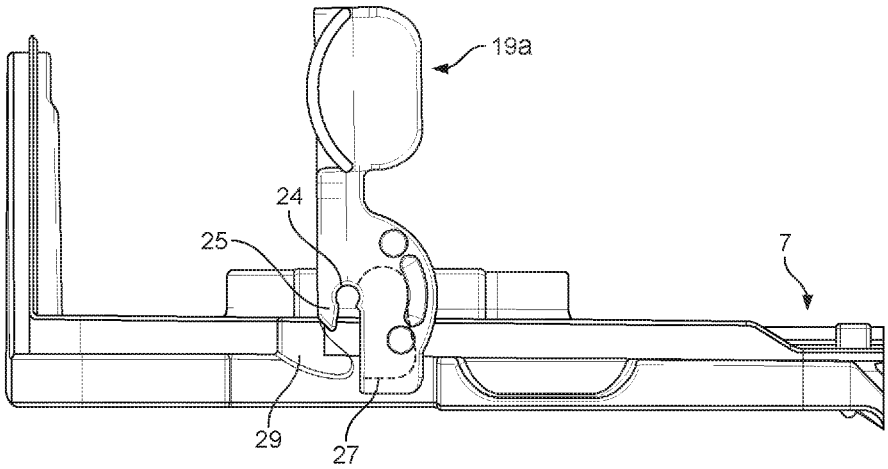

FIGS. 9*a* to 9*c* illustrate operation of the catch 19*a*.

The catch 19*a* is obscured slightly by the brush housing 5 when it is in situ (see FIG. 8) and so the brush housing 5 has been omitted in FIGS. 9*a* to 9*c* to admit a better view of the catch 19*a*.

The catch 19*a* is pivotally mounted on the brush housing 5 via a journal part 24 which clips onto a corresponding axle (not shown) on the brush housing 5. The axis of rotation of the catch 19*a* thus extends into the page in FIGS. 9*a* to 9*b*.

The catch 19*a* comprises a catch recess 23 (hidden from view, but shown in phantom in FIG. 9*a*), a first cam 25 and a second cam 27 which, in this case, is formed by the walls of the catch recess 23.

The catch recess 23 engages with a corresponding projection 29 on the soleplate 7 to hold the soleplate 7 closed. In FIG. 9*a*, the catch 19*a* is shown in its locking position, fully engaged with the locking projection 29.

To release the catch 19*a*, the catch 19*a* is manually rotated anti-clockwise (indicated by the arrow C in FIGS. 9*a* and 9*b*).

The release action of the catch 19*a* is a cam-action, resulting from co-operation of the first cam 25 with the locking projection 29. This is illustrated in FIG. 9*b*, which shows an intermediate position for the catch 19*a*, between the locking position and a full release position. Here, the first cam 25 has engaged with the projection 29 and, as the catch 19*a* is pivoted towards the full release position, 'pushes' on the projection 29 to force apart the housing 5 and the soleplate assembly 7 (indicate by the arrow D in FIG. 9*b*). This initial pushing movement helps alert the user to the fact that the catch 19*a* releases the soleplate assembly 7 from the brush housing 5.

The full release position for the catch 19*a* is shown in FIG. 9*c*. Here, the recess 23 is fully disengaged from the locking projection 29, allowing detachment of the soleplate assembly 7 from the brush housing 5.

The locking action of the catch 19*a* is also a cam-action, resulting from co-operation of the second cam 27 with the locking projection 29. Thus, as the catch 19*a* is rotated back towards the locking position in FIG. 9*a*, the second cam 27 'pulls' against the locking projection 27*a* to force the soleplate assembly 7 and housing 5 back together. The catch 19*a* is effectively designed to 'gather' the locking projection as it pivots back towards the locking position. Consequently, the user does not need to hold the soleplate assembly 7 and housing 5 together when locking the catch 19*a*: close proximity of the relevant edges of the housing 5 and soleplate assembly 7 will suffice.

The catch 19*b* pivots in the reverse sense to catch 19*a*, but otherwise operates in the same way.

The catches 19*a*, 19*b* can each be operated by grasping the respective end of the cleaner head 3 and using the thumb to pivot the catch. The catches 19*a*, 19*b* are thus arranged for simultaneous operation using two hands. This is facilitated in part by the fact that the catches pivot about respective pivot axes which extend front-to-back (into the page in FIGS. 9*a* to 9*c*), providing for a natural, comfortable movement of the user's thumb to pivot the catches 19*a*, 19*b* between the locking position and release position.

The invention claimed is:

1. A cleaner-head for a vacuum cleaner, the cleaner-head comprising a housing, the housing connected to a hinged soleplate assembly which can be opened and closed to provide access to the inside of the housing, the soleplate assembly being a clip-on assembly which a user can manually un-clip from the housing to detach the soleplate assembly for separate cleaning or replacement, wherein the soleplate assembly comprises first resilient tabs and the housing comprises second resilient tabs, and the first and second resilient tabs are configured to clip together to form a hinged connection between the soleplate assembly and the housing.

2. The cleaner head of claim 1, wherein the first and second resilient tabs are configured so that a user can clip them together to hinge the soleplate assembly on the housing and then subsequently un-clip them to detach the soleplate assembly from the housing.

3. The cleaner head of claim 2, wherein the first and second resilient tabs are provided towards the front of the housing and the soleplate assembly.

4. The cleaner head of claim 3, wherein the soleplate assembly comprises a soleplate and a bumper running along the front of the soleplate, and the first resilient tabs are provided on the bumper.

5. The cleaner head of claim 3, wherein the hinged soleplate is held closed on the housing by a catch located towards the rear of the housing.

6. The cleaner head of claim 5, wherein the catch is pivotally mounted on the housing and is configured to pivot relative to the housing between lock and release positions.

7. The cleaner head of claim 1, wherein the soleplate assembly comprises a bumper and the soleplate assembly is configured to rotate about the hinged connection at least until an outer surface of the bumper contacts an outer surface of the housing.

8. The cleaner head of claim 7, wherein the first and second resilient tabs are configured to be pried apart by rotation of the soleplate assembly relative to the housing while the outer surface of the bumper contacts the outer surface of the housing.

* * * * *